United States Patent [19]

Evans

[11] Patent Number: 4,599,950

[45] Date of Patent: Jul. 15, 1986

[54] ARTICLE OF FURNITURE AND METHOD OF MAKING SAME

[75] Inventor: Paul R. Evans, New Hope, Pa.

[73] Assignee: Design Institute America, Inc., Montpelier, Ohio

[21] Appl. No.: 695,613

[22] Filed: Jan. 28, 1985

[51] Int. Cl.[4] ..... A47B 13/12

[52] U.S. Cl. ..... 108/150; 108/161; 156/89; 428/120

[58] Field of Search ..... 108/150, 161, 159; 156/89; 297/DIG. 6; 428/120

[56] References Cited

U.S. PATENT DOCUMENTS

| | | | |
|---|---|---|---|
| 775,006 | 11/1904 | Groll et al. | 108/150 |
| 1,438,805 | 12/1922 | Ambler | 108/150 |
| 2,266,926 | 12/1941 | Vida | 427/269 X |
| 2,694,016 | 11/1954 | Craven et al. | 427/79 |
| 2,734,840 | 2/1956 | Kane | 156/89 |
| 3,052,573 | 9/1962 | Dumesnil | 252/514 |
| 3,089,782 | 5/1963 | Bush et al. | 427/269 |
| 3,208,795 | 9/1965 | Schultz | 108/150 X |
| 3,325,266 | 6/1967 | Stong | 428/120 X |
| 3,742,871 | 7/1973 | Kienel | 108/161 X |
| 4,170,688 | 10/1979 | Roentgen et al. | 156/89 X |
| 4,201,816 | 5/1980 | Bertelsen | 428/131 X |
| 4,243,710 | 1/1981 | Magrini et al. | 428/208 |
| 4,321,875 | 3/1982 | Danko | 108/150 |

*Primary Examiner*—Henry F. Epstein

*Attorney, Agent, or Firm*—Marshall & Melhorn

[57] ABSTRACT

An article of furniture and a method of making the same wherein a glass enamel is fused to the supporting surface of an extended surface glass member. A supporting member is then adhesively secured to the fused glass enamel to provide the desired support for the glass member.

11 Claims, 3 Drawing Figures

ARTICLE OF FURNITURE AND METHOD OF MAKING SAME

BACKGROUND OF THE INVENTION

In the manufacture of furniture, styles and design appearance are constantly changing to meet the changing demands of the marketplace.

The use of glass has become an ever increasing factor in the manufacture of furniture. Glass has many features which lend utilitarian attributes to the associated furniture as well as the aesthetic attributes. Heretofore, the use of glass in the manufacture of tables, for example, has been somewhat limited. Glass tops have been employed as protective coverings over coffee tables, cocktail tables, desks, and the like. Typically, in such environment, the glass tops have satisfactorily functioned to protect the underlying supporting surface from scratching, marring, soiling, and discoloration caused by moisture and alcohol, for example. Since the glass surface is typically inert to all of the foregoing, it has functioned well.

Also, glass tops have been employed in the manufacture of tables, wherein the glass top is supported by a frame-like portion of the table. In such items, since the supporting frame for the glass top is disposed only at peripheral portions of the glass top, the central area of the table is thereby rendered optically transparent to provide an attractive overall appearance generally perceived as having less overall mass.

In a great many instances, in furniture employing glass tops, the supporting base portion consumes a major portion of space between the undersurface of the glass top; or alternatively, leg supports are disposed at spaced intervals typically located adjacent the corners when rectangular top configurations are used.

It has been difficult to design furniture, and especially tables, employing glass tops, wherein the glass top extends outwardly from a single centrally located support.

Other structures for supporting glass tops for tables have included the formation of apertures extending through the table top for reception of threaded fasteners for attaching leg support structures. In these instances, the structural aspects have been acceptable, but the resultant top surfaces of the glass tops are typically interrupted by the head portions of the fasteners.

It is an object of the present invention to produce a table employing a glass top which can extend outwardly from a centrally located support, for example, resulting in an aesthetically attractive item of furniture having a minimum of encumbered space beneath the top, and an uninterrupted top surface.

SUMMARY OF THE INVENTION

The objectives of the invention are achieved by producing an article of furniture employing a glass top, a supporting base, and a means to securely affix the undersurface of the glass top to the facing surface of the supporting base and leaving the uppermost surface of the glass top completely unencumbered.

The product of the invention typically includes a supporting base member having a lower portion in contact with a supporting surface and an upper portion with an upwardly facing surface; a glass top member having an upper surface and a lower surface; a layer of glass enamel applied to a portion of the lower surface of the top member; and an adhesive layer interposed between the upwardly facing surface of the base member and the layer of ceramic paint to compatibly adhere the top member to the supporting base.

A typical method of making the invention includes the steps of applying a layer of glass enamel composition to a portion of the lower surface of a glass top; heating the layer of glass enamel and glass top to a temperature sufficient to cause the glass enamel composition to fuse to the associated adjacent glass surface; and adhesively bonding the exposed surface of the fused glass enamel to an upwardly facing surface of a supporting base to effect an adhesive bond therebetween.

BRIEF DESCRIPTION OF THE DRAWINGS

A more complete understanding of the invention will become clearly manifest to those skilled in the art from reading the following detailed description of a preferred embodiment of the invention when considered in the light of the accompanying drawings, in which.

DETAILED DESCRIPTION OF PREFERRED EMBODIMENT OF THE INVENTION

Figure 1:
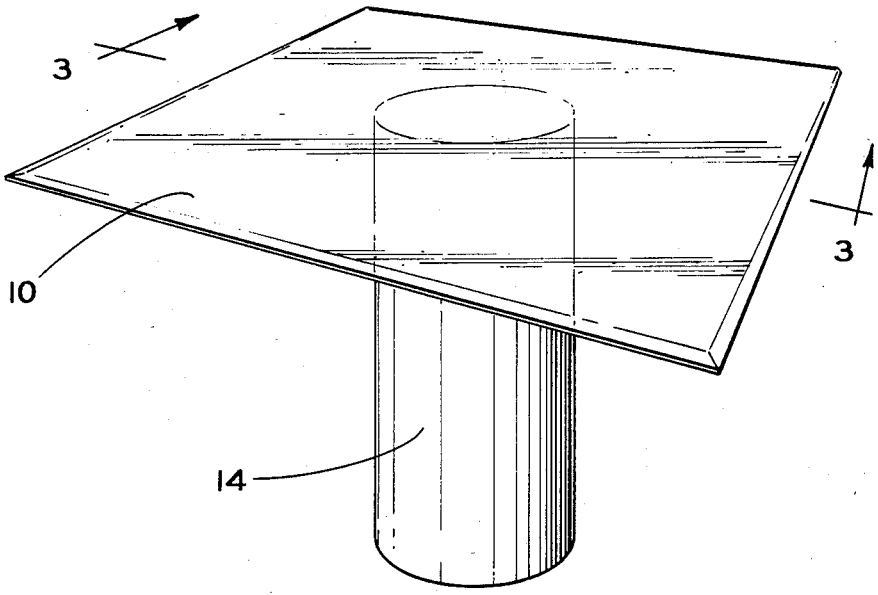
FIG. 1 is a perspective view of a table embodying the features of the invention.
Figure 3:
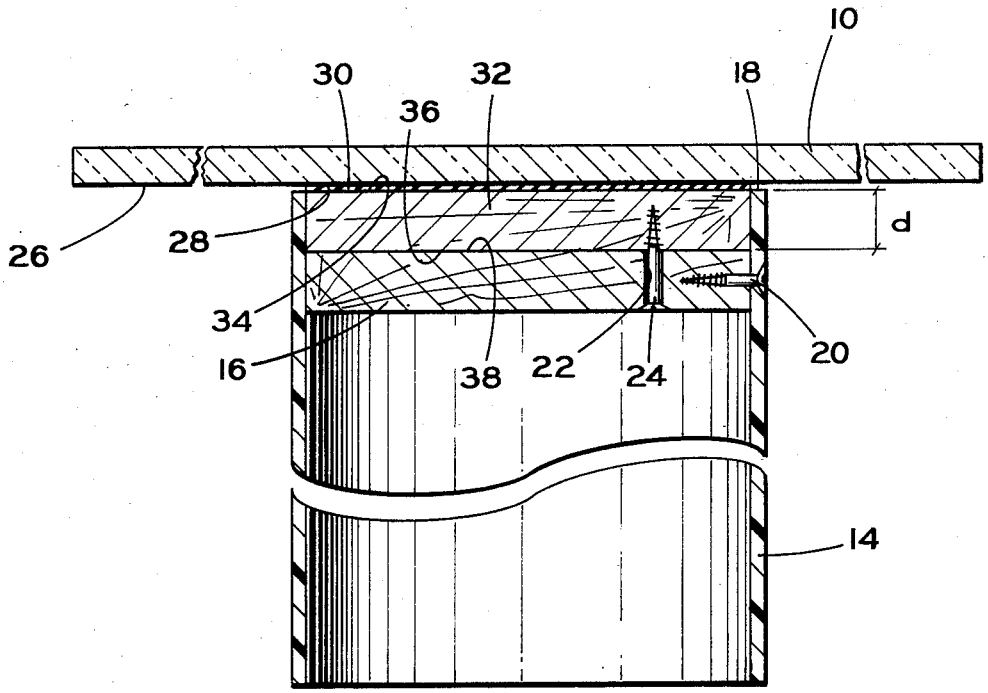
FIG. 3 is a sectional view of the invention illustrated in FIG. 1 taken along line 3—3 thereof.
Figure 2:
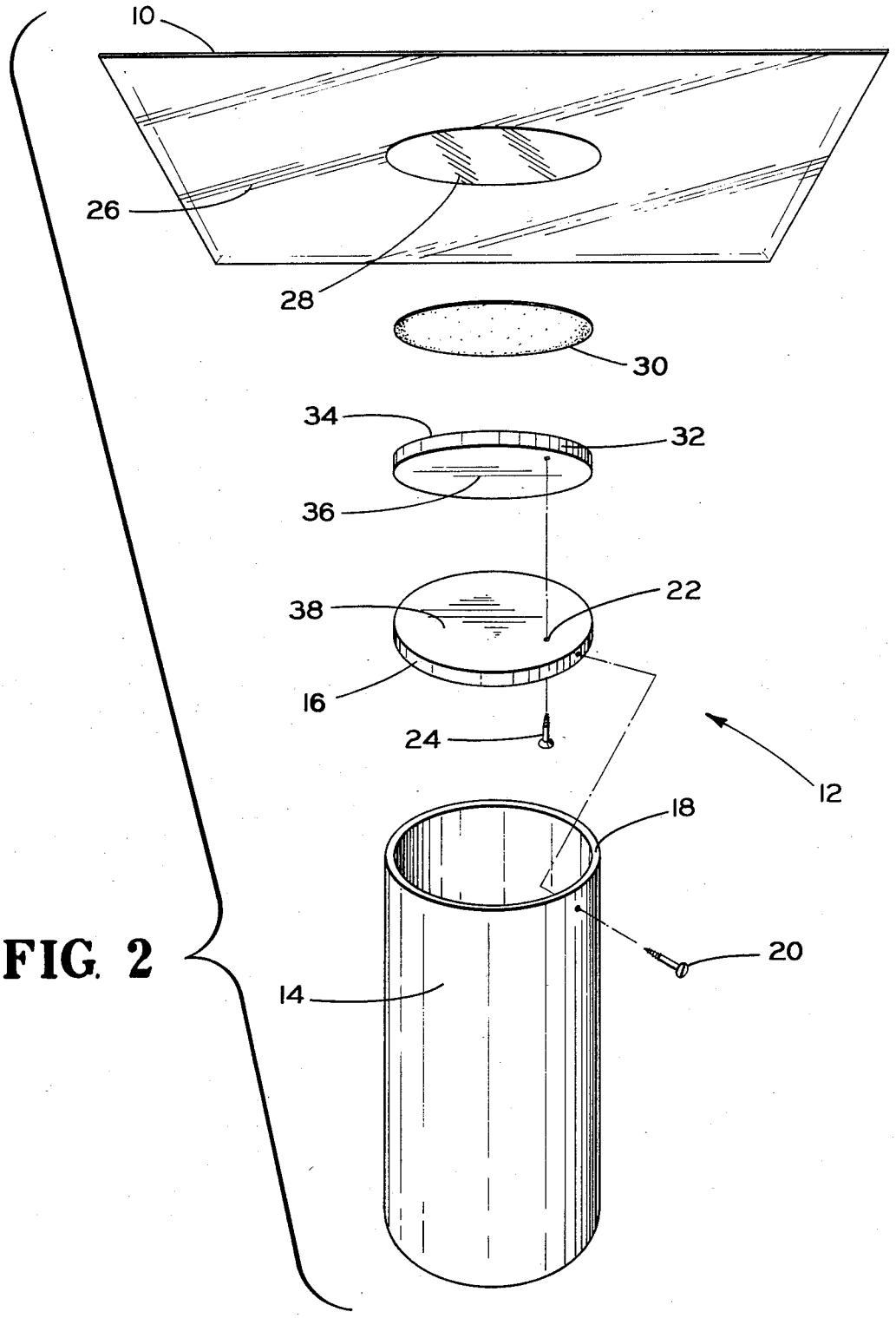
FIG. 2 is an exploded view of the table illustrated in FIG. 1.

Referring to the drawings, there is shown a table incorporating the features of the present invention. The table includes a top 10, formed from a single piece of flat, optically transparent glass, and a base member 12.

The base member 12 includes a hollow cylindrical pipe section 14, which may typically be a section of plastic pipe formed of polyvinyl chloride (PVC) having a wall thickness of approximately $\frac{3}{4}$ inches and an inner diameter of approximately $9\frac{1}{4}$ inches, when employed in association with a glass table top of approximately 36 inches square. Disposed within the interior of the pipe section 14 is a wooden annular plug member 16. The plug member 16 is positioned within the pipe section such that the upper surface is a distance d from the uppermost edge 18 of the pipe section. The plug member 16 is typically maintained within the interior of the pipe member 14 by means of suitably positioned radially inwardly projecting threaded fasteners 20, such as wood screws, for example. While only a single fastening 20 is illustrated in the drawings, it will be understood that, in practice, a series of such fasteners is typically employed.

A series of passageways 22 is formed in the plug member 16 to receive threaded fasteners 24, such as wood screws, for example. Only a single passageway 22 is illustrated for simplicity.

The top 10 is preferably formed of optically transparent glass which may be of any desired shape and area and may typically be approximately $\frac{3}{4}$ inches thick. The lower surface 26 of the glass top 10 has a layer 28 of glass enamel fused thereto. The layer 28 is formed by silk screening a pigment containing composition to the lower surface of the table top to present a decorative appearance to the upper portion of the table top and also, tends to disguise lower surface of the table top at the region of the interconnection with the supporting base member.

The layer 28 may be typically formed from a composition of a pigment, glass powder or frit, and an associated vehicle such as pine oil, for example, to form a slurry which can be employed in a silk screening process for the application thereof to the under surface of the glass top prior to the heating and fusing operation.

It is desired in most instances to render the layer 28 optically opaque. The resultant choice of pigment for the layer 28 is dependent upon the design or decorative parameters of the furniture designers. It has been found that black is a somewhat universally acceptable color for the layer 28.

Typically, the selected pigment is dispersed with a glass frit composition which may comprise glass frit particles which may be lead-bearing or lead-free compositions dispersed into a suitable application medium adapted for a silk screening application, such as pine oil. Examples of screen printing vehicles are disclosed in U.S. Pat. Nos. 4,243,710, 2,694,016, 3,089,782, and 3,052,573.

To this composition may be added selected inorganic color pigments or material, as will be understood in the art, such as for example a cobalt chrome iron oxide for effecting a black color. It will be understood that other color rendering materials can be used such as cadmium-selenium oxide for effecting a red color, chromium oxide for effecting a green color, and cobalt oxide for exhibiting a blue color, and other like selective inorganic color exhibiting materials well known in the art for producing a characteristic color.

The process for creating the layer 28 includes silk screening the above composition on to the desired area, which, in the present example, is an area of substantially the same shape and the same area as the cross-sectional area of the pipe 14. The glass top 10 and the silk screened layer 28 are then placed into the interior of an oven, for example, and are fired at an elevated, as determined by the glass frit and pigment composition whereby a vitreous decorative opaque coating is fused onto the associated glass surface. More specifically, ination is fired at a temperature of approximately 1290° F. for a period sufficient to cause the composition to be fused into the under surface 26 of the glass top 10. It will be understood that the glass frit material is formulated such that it will melt at a temperature lower than the glass top 10, thereby causing the pigment particles already mixed with the glass frit particles to be held in the dispersed condition within a glass matrix formed by the fused frit.

After the composition has been fused, it is allowed to be cooled in a controlled manner to avoid any undesired stresses. The bond between the resultant layer 28 and the adjacent surface is extremely tenacious indicating that during the fusing operation, a molecular action occurs at the interface resulting in at least a certain amount of the pigment/frit substituents actually entering into and reacting with the glass of the top 10.

In the preferred embodiment of the invention, it has been found that the exposed surface of layer 28 is matte in appearance.

The resultant cooled assembly is positioned to receive a layer 30 of adhesive material, such as for example, an adhesive sold by the Dow Chemical Company under the trademark designation of No. 999. The adhesive layer 30 is applied to the exposed area of the fused layer 28.

Prior to the curing of the adhesive layer 30, a wooden plug member 32 is disposed thereon. Typically, the plug member 32 is of substantially the same shape as the annular wooden plug member 16 and has a thickness of at least the distance d. The plug member 32 has an upper surface 34 which is disposed in juxtaposition on the adhesive layer 30, and a lower surface 36 adapted to be received by and rest on the upper surface 38 of the wooden plug member 16.

After the adhesive layer 30 has satisfactorily effected a secure bond between the exposed surface of the fused layer 28 and the upper surface 34 of the plug member 32, the assemblage consisting of the glass top 10, layer 28, adhesive layer 30, and plug member 32 is positioned such that the plug member 32 is disposed within the upper end of the pipe 14 so that the lower surface 36 of the member 32 is disposed adjacent the upper surface 38 of the plug member 16 of the base 12. The assemblies are thence secured to one another by causing the threaded fasteners 24 to be screwed into the plug member 32 to thereby complete the table assembly as illustrated in FIG. 1. Obviously, the number of threaded fasteners 24 will vary dependent upon the size and weight of the associated components.

While mention has been made of the utilization of polyvinyl chloride for the member 14, it will be understood that many other materials having various shapes may be employed in lieu of that illustrated without departing from the spirit of the invention.

It can be seen that the invention has produced a table having a glass article supporting top surface which may be readily and economically manufactured, and, at the same time, presents many interesting design variations to furniture designers.

What is claimed is:

1. An article of furniture comprising:

a supporting base member having one portion in contact with a supporting surface and an oppositely spaced apart portion with an outwardly facing surface;

a glass member having at least two spaced apart substantially parallel surfaces;

a layer of glass enamel fused to a portion of at least one of the surfaces of said glass member; and an adhesive layer interposed in intimate contact between the outwardly facing surface of said base member and said layer of glass enamel to compatibly adhere said glass member to said supporting base member.

2. An article of furniture as defined in claim 1 wherein said glass enamel is silk screened to the lower surface of said glass member.

3. An article of furniture as defined in claim 2 wherein said glass enamel includes glass frit.

4. An article of furniture as defined in claim 3 wherein said glass enamel contains a color producing pigment.

5. An article of furniture as defined in claim 4 wherein said glass enamel is opaque.

6. An article of furniture comprising:

a supporting base member in the form of a hollow cylindrical pipe having a lower portion in contact with a supporting surface, and having an upper portion with an upwardly facing surface;

a glass top member having an upper surface and a lower surface;

a layer of glass enamel fused to a portion of the lower surface of said top member;

a plug member having an upper surface adhesively secured to said layer of glass enamel and a lower surface adapted to be supported by the upwardly facing surface of the upper portion of said base member; and means for fastening said plug member to the upwardly facing surface of the upper portion of said base member.

7. A method of making an article of furniture having a glass member having first and second spaced apart surfaces and a supporting member including the steps of:

applying a layer of a mixture of glass frit and color producing pigment to a portion of at least one of the surfaces of the glass member;

heating the mixture and the glass member to a temperature sufficient to cause the mixture to fuse to the associated glass surface;

allowing the glass member and associated fused mixture to cool; and applying a layer of adhesive material in intimate contact with the fused mixture and the supporting member to cause the fused mixture and the supporting member to effect an adhesive bond between the glass member and the supporting member.

8. A method of making an article of furniture having a glass top having an upper surface and a lower surface and a supporting base having a lower floor engaging portion and an upper portion with an upwardly facing surface including the steps of:

applying a layer of a mixture of glass frit and color producing pigment to a portion of the lower surface of the glass top;

heating said layer and glass top to a temperature sufficient to cause the mixture to fuse to the associated surface of the glass top;

allowing the glass top and the fused mixture to cool; and applying a layer of adhesive material to cause the fused mixture and the upwardly facing portion of the supporting base to effect an adhesive bond between the base and the top.

9. A method of making an article of furniture as defined in claim 8 wherein the mixture of glass frit and pigment is heated to a temperature of approximately 1290° F. for a period sufficient to cause the mixture to fuse to the associated glass.

10. A method of making an article of furniture as defined in claim 8 wherein the mixture is formed of an inorganic pigment, glass frit, and a suitable carrier liquid.

11. A method of making an article of furniture as defined in claim 8 wherein the substituents forming the mixture are applied by a silk screening process.

* * * * *